US011562847B2

(12) United States Patent
Kang et al.

(10) Patent No.: US 11,562,847 B2
(45) Date of Patent: Jan. 24, 2023

(54) COIL COMPONENT

(71) Applicant: SAMSUNG ELECTRO-MECHANICS CO., LTD., Suwon-si (KR)

(72) Inventors: Byung Soo Kang, Suwon-si (KR); Yoon Mi Cha, Suwon-si (KR); Ju Hwan Yang, Suwon-si (KR); Yong Hui Li, Suwon-si (KR); Seo Eun Kim, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 435 days.

(21) Appl. No.: 16/774,669

(22) Filed: Jan. 28, 2020

(65) Prior Publication Data

US 2021/0027932 A1 Jan. 28, 2021

(30) Foreign Application Priority Data

Jul. 24, 2019 (KR) ..... 10-2019-0089408

(51) Int. Cl.

| | |
|---|---|
| ***H01F 27/28*** | (2006.01) |
| ***H01F 41/04*** | (2006.01) |
| ***H01F 27/29*** | (2006.01) |
| ***H01F 17/00*** | (2006.01) |

(52) U.S. Cl.

CPC ..... *H01F 27/2804* (2013.01); *H01F 17/0006* (2013.01); *H01F 27/2852* (2013.01); *H01F 27/29* (2013.01); *H01F 27/292* (2013.01); *H01F 41/041* (2013.01); *H01F 2017/0073* (2013.01); *H01F 2027/2809* (2013.01)

(58) Field of Classification Search

CPC ..... H01F 17/0013; H01F 27/292; H01F 2027/2809; H01F 27/2804; H01F 41/041; H01F 17/0006; H01F 27/29

See application file for complete search history.

(56) References Cited

U.S. PATENT DOCUMENTS

| | | | |
|---|---|---|---|
| 2008/0123248 A1 | 5/2008 | Kunishi et al. | |
| 2016/0189840 A1 | 6/2016 | Ahn et al. | |
| 2017/0133146 A1 | 5/2017 | Lee | |

FOREIGN PATENT DOCUMENTS

| | | | |
|---|---|---|---|
| KR | 10-2008-0033473 A | 4/2008 | |
| KR | 2014135644 A | * 11/2014 | ..... H01F 17/04 |
| KR | 10-1709841 B1 | 2/2017 | |
| KR | 10-2017-0053913 A | 5/2017 | |

* cited by examiner

*Primary Examiner* — Ryan Johnson

(74) *Attorney, Agent, or Firm* — Morgan, Lewis & Bockius LLP

(57) ABSTRACT

A coil component includes a body; a support substrate embedded in the body; a coil portion disposed on the support substrate, and having an end portion exposed to a surface of the body; and an external electrode disposed on the surface of the body, and in contact with and connected to the end portion of the coil portion. An interface between the end portion of the coil portion and the external electrode, and an interface between the surface of the body and the external electrode are located on levels different from each other.

20 Claims, 8 Drawing Sheets

F

COIL COMPONENT

CROSS-REFERENCE TO RELATED APPLICATION(S)

This application claims benefit of priority to Korean Patent Application No. 10-2019-0089408 filed on Jul. 24, 2019 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used together with a resistor and a capacitor in electronic devices.

In accordance with the implementation of high performance and miniaturization in electronic devices, coil components used in electronic devices have increased in number and decreased in size.

In the case of a general thin film type inductor, a plurality of coil portion are formed on a large-area substrate, a magnetic composite sheet is stacked, and then diced to manufacture a body of individual components in a batch.

After the dicing process, a surface of the body is polished to remove contaminants remaining on the surface of the body (e.g., an insulating material and burrs of the conductor, and the like), and as a size of the body is reduced, difficulty in the polishing process becomes gradually higher.

SUMMARY

An aspect of the present disclosure is to provide a coil component that can omit a polishing process.

Another aspect of the present disclosure is to provide a coil component capable of improving coupling reliability between an end portion of the coil portion and the external electrode.

According to an aspect of the present disclosure, a coil component is provided. The coil component includes a body; a support substrate embedded in the body; a coil portion disposed on the support substrate, and having an end portion exposed to a surface of the body; and an external electrode disposed on the surface of the body, and in contact with and connected to the end portion of the coil portion. An interface between the end portion of the coil portion and the external electrode and an interface between the surface of the body and the external electrode are located on levels different from each other.

According to an aspect of the present disclosure, a coil component is provided. The coil component includes a body; a support substrate embedded in the body; a coil portion disposed on the support substrate, and having an end portion exposed to a surface of the body; and an external electrode disposed on the surface of the body, and in contact with and connected to the end portion of the coil portion. A surface roughness of one surface of the end portion exposed from the surface of the body is higher than a surface roughness of another surface of the end portion of the coil portion embedded in the body.

According to an aspect of the present disclosure, a coil component is provided. The coil component includes a body; a support substrate embedded in the body; a coil portion disposed on the support substrate, and having an end portion exposed to a surface of the body; and an external electrode disposed on the surface of the body, and in contact with and connected to the end portion of the coil portion. A surface roughness of the interface between the end portion of the coil portion and the external electrode is higher than a surface roughness of the interface between the surface of the body and the external electrode.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
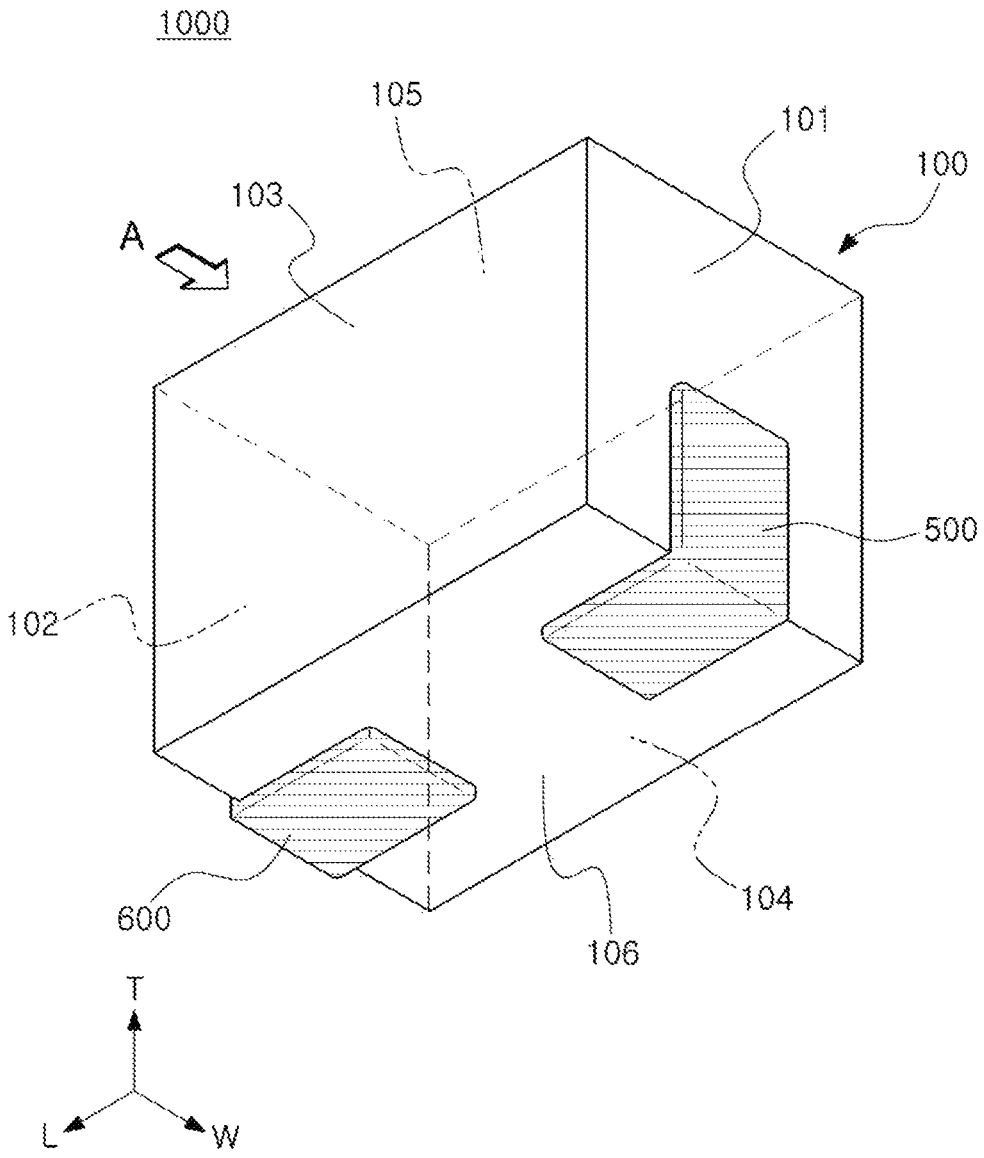
FIGS. 1 and 2 are views schematically illustrating a coil component viewed from a lower side according to an embodiment of the present disclosure, respectively.

Hereinafter, embodiments of the present disclosure will be described as follows with reference to the attached drawings. The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or beneath an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, a T direction is a third direction or a thickness direction.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or the like.

In other words, in electronic devices, a coil component may be used as a power inductor, a high frequency (HF) inductor, a general bead, a high frequency (GHz) bead, a common mode filter, and the like.

Figure 2:
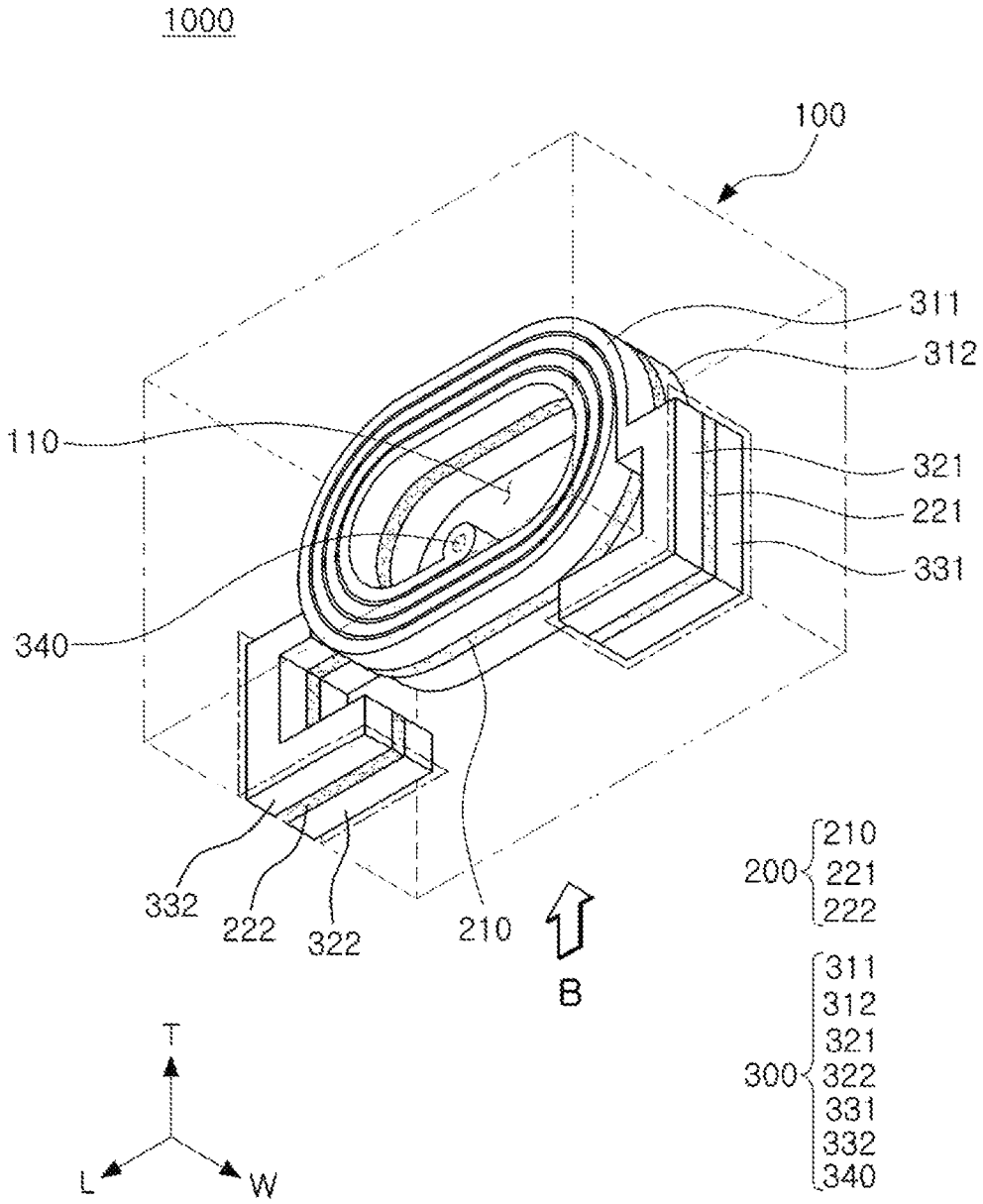
Figure 3:
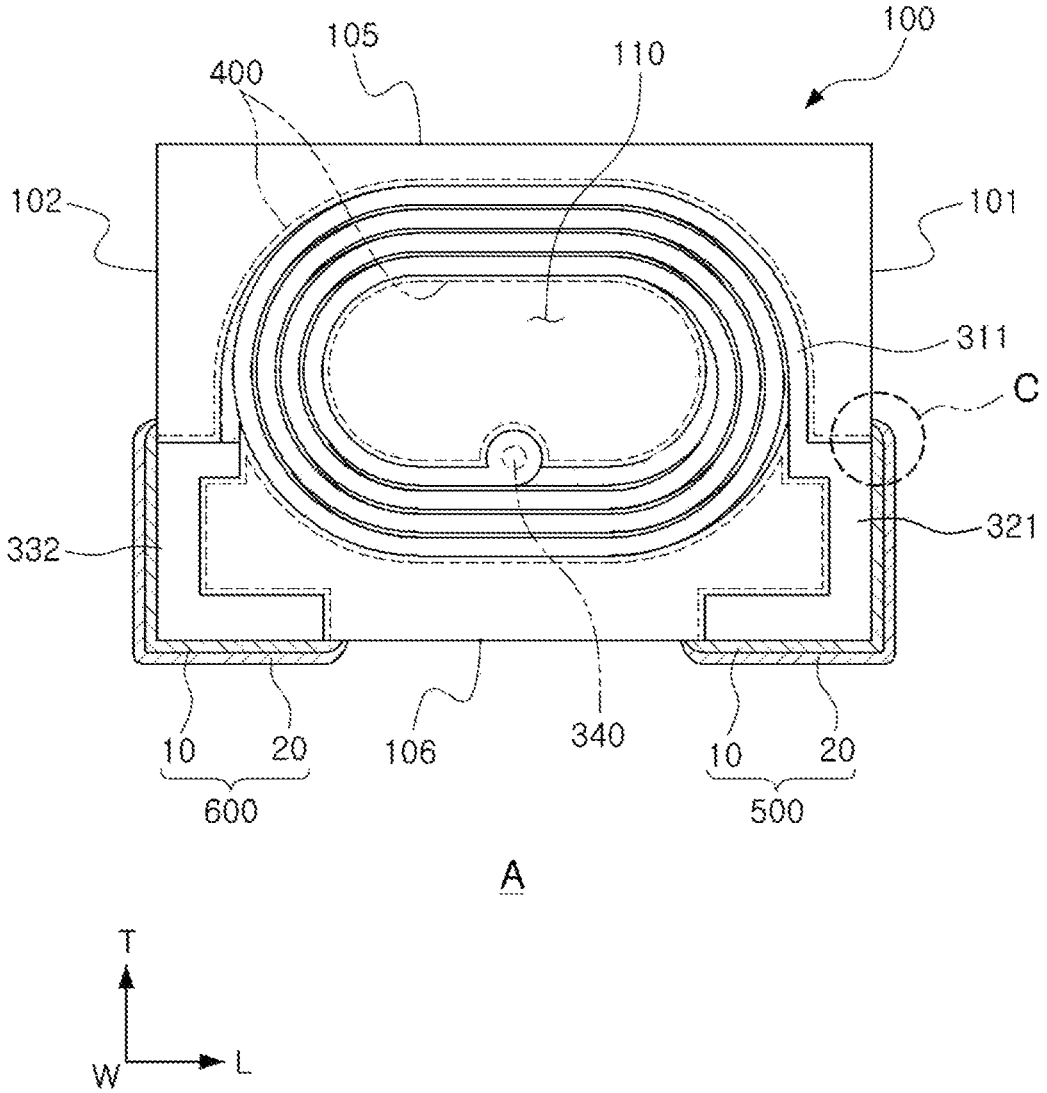
FIG. 3 is a view schematically illustrating what is seen in the direction A of FIG. 1.
Figure 4:
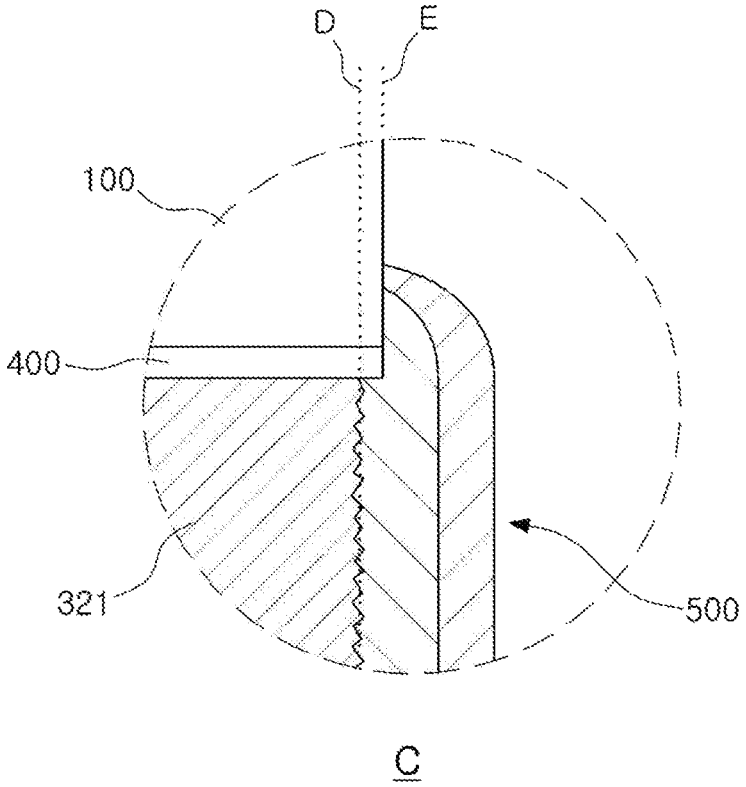
FIGS. 4 and 5 are enlarged views of region C of FIG. 3, respectively.
Figure 5:
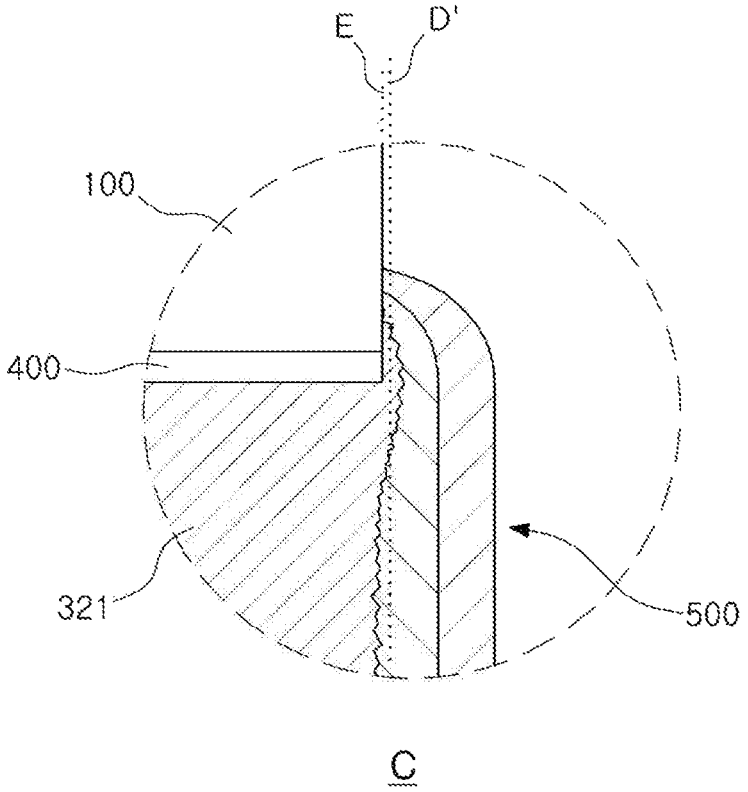
Figure 6:
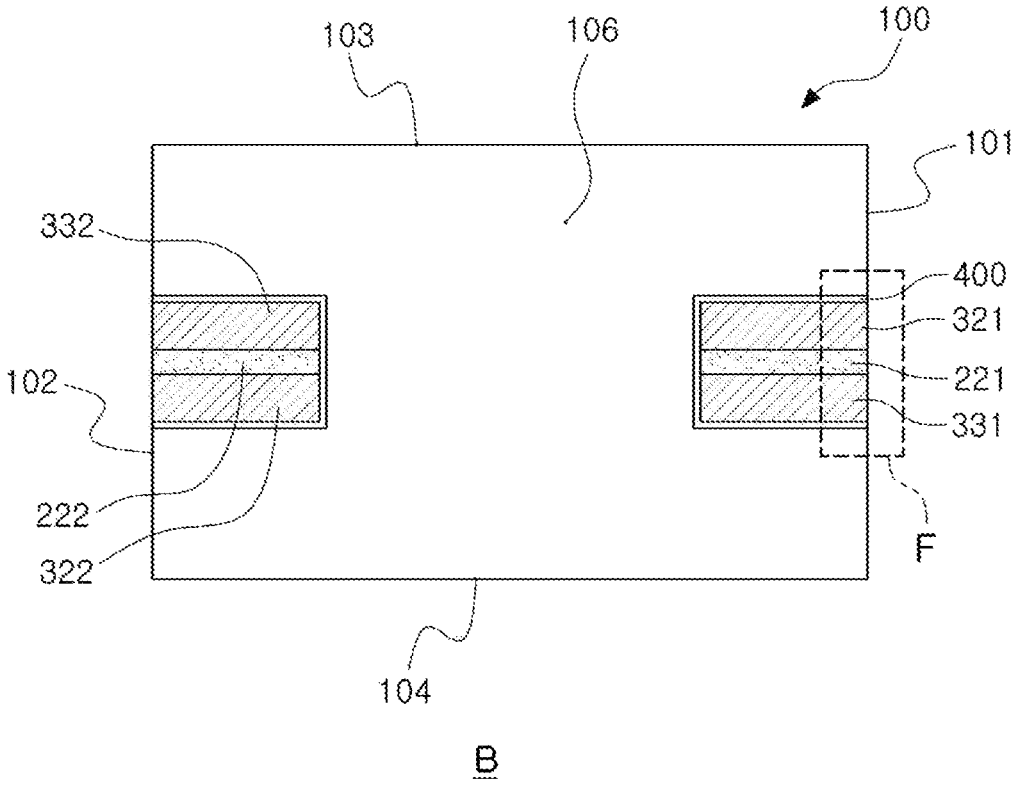
FIG. 6 is a view schematically illustrating what is seen in the direction B of FIG. 2.
Figure 7:
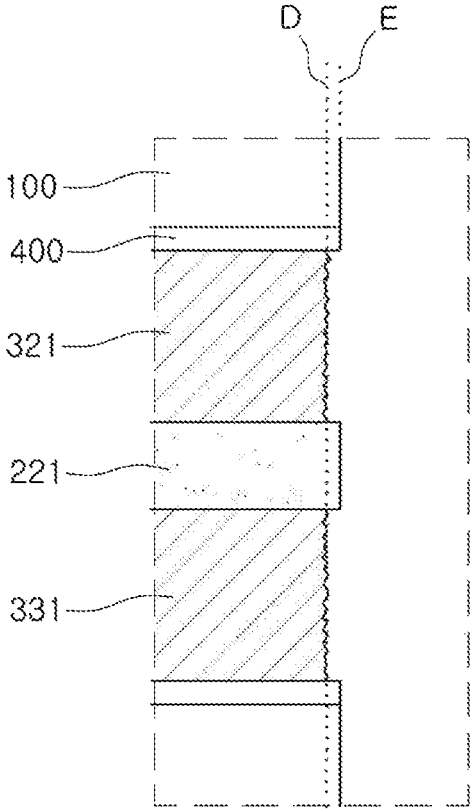
FIGS. 7 and 8 are enlarged views of region F of FIG. 6, respectively.
Figure 8:
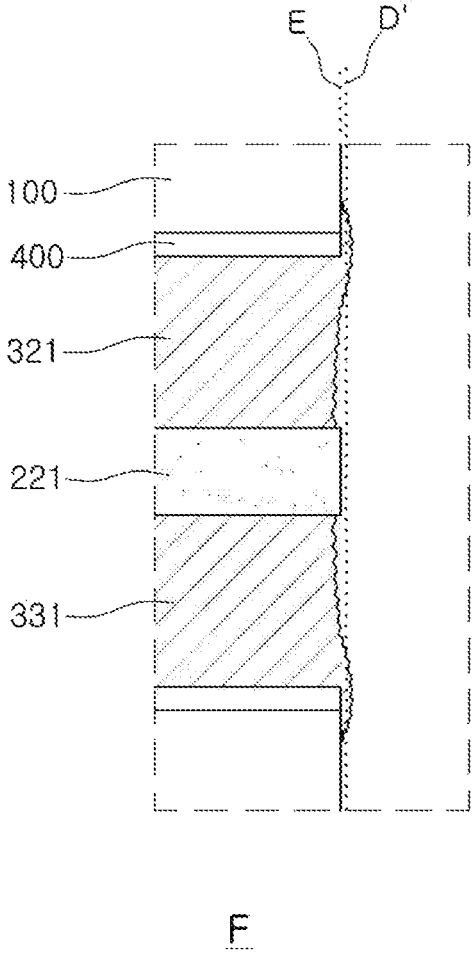

FIGS. 1 and 2 are views schematically illustrating a coil component viewed from a lower side according to an embodiment of the present disclosure, respectively. FIG. 3 is a view schematically illustrating what is seen in the direction A of FIG. 1. FIGS. 4 and 5 are enlarged views of region C of FIG. 3, respectively. FIG. 6 is a view schematically illustrating what is seen in the direction B of FIG. 2. FIGS. 7 and 8 are enlarged views of region F of FIG. 6, respectively. Meanwhile, for clarity, FIG. 1 mainly illustrates the exterior of the coil component according to the present embodiment, and FIG. 2 mainly illustrates an internal structure of the present embodiment by omitting some components from FIG. 1. In addition, for the sake of clarity, FIG. 3 mainly illustrates the internal structure as viewed from the direction A in FIG. 1.

Referring to FIGS. 1 to 8, a coil component 1000 according to an embodiment of the present disclosure may include a body 100, a support substrate 200, a coil portion 300, an insulating film 400, and external electrodes 500 and 600. The support substrate 200 includes a support portion 210 and end portions 221 and 222. The coil portion 300 includes coil patterns 311 and 312, lead-out patterns 321 and 322, auxiliary lead-out patterns 331 and 332, and a via 340.

The body 100 forms an exterior of the coil component 1000 according to the present embodiment, and embeds the support substrate 200, the coil portion 300, and the insulating film 400 therein.

The body 100 may have a hexahedral shape as a whole.

Referring to FIG. 1, The body 100 includes a first surface 101 and a second surface 102 facing each other in a longitudinal direction L, a third surface 103 and a fourth surface 104 facing each other in a width direction W, and a fifth surface 105 and a sixth surface 106 facing each other in a thickness direction T. Each of the first to fourth surfaces 101, 102, 103, and 104 of the body 100 corresponds to a wall surface of the body 100 connecting the fifth surface 105 and the sixth surface 106 of the body 100. Hereinafter, both end surfaces of the body 100 may mean the first surface 101 and the second surface 102 of the body and both side surfaces of the body 100 may mean the third surface 103 and the fourth surface 104 of the body 100. In addition, one surface and the other surface of the body 100 may mean the sixth surface 106 and the fifth surface 105 of the body 100, respectively.

As an example, the body 100 may be formed such that the coil component 1000 according to the present embodiment in which external electrodes 500 and 600 are formed to be described later has a length of 1.0 mm, a width of 0.6 mm, and a thickness of 0.8 mm, but is not limited thereto. Meanwhile, since the numerical values described above are merely numerical values on design that do not reflect process errors and the like, it should be considered that they are within the scope of the present disclosure to an extent that process errors may be recognized.

The body 100 may include a magnetic material and a resin. As a result, the body 100 has magnetic properties. The body 100 may be formed by stacking one or more magnetic composite sheets including a resin and a magnetic material dispersed in the resin. However, the body 100 may have a structure different from the structure in which a magnetic material is dispersed in a resin. For example, the body 100 may be formed of a magnetic material such as a ferrite.

The magnetic material may be a ferrite or magnetic metal powder.

The ferrite powder may include, for example, at least one or more materials among a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include any one or more elements selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be any one or more materials among a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be Fe—Si—B—Cr based amorphous alloy powder, but is not limited thereto.

The ferrite and the magnetic metal powder may have an average diameter of about 0.1 μm to 30 μm, respectively, but are not limited thereto.

The body 100 may include two or more types of magnetic materials dispersed in a resin. Here, the notion that different kinds of magnetic materials may indicate that the magnetic material dispersed in the resin is distinguished from each other by at least one of an average diameter, a composition, crystallinity, and a shape.

The resin may include one of an epoxy, a polyimide, a liquid crystal polymer, or mixture thereof, but is not limited thereto.

The body 100 may include a core 110 penetrating through an inside the coil portion 300 and the support substrate 200 to be described later. The core 110 may be formed by filling a through hole formed inside of the support substrate 200 and the coil portion 300 with a magnetic composite sheet, but is not limited thereto.

The support substrate 200 is embedded in the body 100. Specifically, the support substrate 200 is embedded in the body 100 to be perpendicular to one surface 106 of the body 100. Therefore, the coil portion 300 disposed on the support substrate 200 is disposed to be perpendicular to, or, or substantially perpendicular to, one surface 106 of the body 100. That is, winding axes of each of coil patterns 311 and 312 of the coil portion 300 may be parallel to, or substantially parallel to, one surface 106 of the body 100. The term, "substantially," reflects consideration of recognizable errors which may occur during manufacturing or measurement.

The support substrate 200 includes a support portion 210 and end portions 221 and 222. The support portion 210 supports coil patterns 311 and 312 to be described later. The first end portion 221 supports a first lead-out pattern 321 and a first auxiliary lead-out pattern 331. The second end portion 222 supports a second lead-out pattern 322 and a second auxiliary lead-out pattern 332. The support portion 210 and the end portions 221 and 222 may be processed from one insulating material and may be integrally formed without boundaries therebetween, but are not limited thereto.

The support substrate 200 may be formed of an insulating material including a thermosetting insulating resin such as an epoxy resin, a thermoplastic insulating resin such as a polyimide, or a photosensitive insulating resin, or may be formed of an insulating material including such an insulating resin and a reinforcing material such as a glass fiber and an inorganic filler. For example, the support substrate 200 may be formed of an material such as prepreg, ajinomoto build-up film (ABF), FR-4, a bismaleimide triazine (BT) resin, a photoimageable dielectric (PID), a copper clad laminate (CCL), and the like, but is not limited thereto.

As an inorganic filler, at least one or more materials selected from a group consisting of silica ($SiO_2$), alumina ($Al_2O_3$) silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate 200 is formed of an insulating material including a reinforcing material, the support substrate 200 may provide improved stiffness. When the support substrate 200 is formed of an insulating material which does not include a glass fiber, the support substrate 200 may reduce a width of the coil component 1000 according to the present embodiment by reducing a thickness of the entire coil portion 300.

The coil portion 300 is disposed on the support substrate 200, and an end portion thereof is exposed to the surface of the body 100. The coil portion 300 is embedded in the body 100 to exhibit characteristics of the coil component. For example, when the coil component 1000 of the present embodiment is utilized as a power inductor, the coil portion 300 may serve to stabilize a power supply of the electronic device by storing an electric field as a magnetic field and maintaining an output voltage.

The coil portion 300 is formed on at least one of both surfaces of the support substrate 200 facing each other, and forms at least one turn. In the present embodiment, the coil portion 300 includes first and second coil patterns 311 and 312 respectively disposed on both surfaces of the support portion 210 facing each other in the width direction W of the body 100 and facing each other, a first lead-out pattern 321 and a first auxiliary lead-out pattern 331 respectively disposed on both surfaces of the first end portion 221 and facing each other, and a second lead-out pattern 322 and a second auxiliary lead-out pattern 332 respectively disposed on both surfaces of the second end portion 222 and facing each other. In addition, the coil portion 300 includes a via 340 penetrating through the support portion 210 to connect the first and second coil patterns 311 and 312 to each other.

Each of the first coil pattern 311 and the second coil pattern 312 may be formed to have a planar spiral shape having at least one turn around a core 110 as an axis. As an example, based on the direction of FIG. 2, the first coil pattern 311 may form at least one turn around the core 110 on one surface of the support portion 210 as an axis. The second coil pattern 312 may form at least one turn around the core 110 on the other surface of the support portion 210 as an axis.

Referring to FIGS. 2, 3, and 6, the first lead-out pattern 321 is disposed on one surface of the first end portion 221 and connected to the first coil pattern 311, and is exposed to one end surface 101 of the body 100 and one surface 106 of the body 100. The second lead-out pattern 322 is disposed on the other surface of the second end portion 222 and connected to the second coil pattern 312, and is exposed to the other end surface 102 of the body 100 and one surface 106 of the body 100. That is, the first and second lead patterns 321 and 322 having an L shape are entirely embedded in the body 100.

When the first lead-out pattern 321 is continuously exposed to the first surface 101 and the sixth surface 106 of the body 100, a contact area with the first external electrode 500, to be described later, may increase, and thus a coupling force therebetween may increase. When the second lead-out pattern 322 is continuously exposed to the second surface 102 and the sixth surface 106 of the body 100, a contact area with the second external electrode 600, to be described later, may increase, and thus a coupling force therebetween may increase.

Referring to FIGS. 2, 3, and 6, the first auxiliary lead-out pattern 331 is disposed on the other surface of the first end portion 221 so as to correspond to the first lead-out pattern 321, and is spaced apart from the second coil pattern 312. The first auxiliary lead-out pattern 331 and the first lead-out pattern 321 are connected to each other by a connection via penetrating through the first end portion 221. The second auxiliary lead-out pattern 332 is disposed on one surface of the second end portion 222 so as to correspond to the second lead-out pattern 322, and spaced apart from the first coil pattern 311. The second auxiliary lead-out pattern 332 and the second lead-out pattern 332 are connected to each other by a connection via penetrating through the second end portion 222. Coupling reliability between the external electrodes 500 and 600 and the coil portion 300 may increase due to the first and second auxiliary lead-out patterns 331 and 332.

The first coil pattern 311 and the first lead-out pattern 321 may be integrally formed such that a boundary is formed therebetween. The second coil pattern 312 and the second lead-out pattern 322 may be integrally formed such that no boundary is formed therebetween. However, this is merely an example, and thus, the above-described configurations are not excluded from the scope of the present disclosure in the case the boundaries are formed at different stages.

At least one of the coil patterns 311 and 312, the lead-out patterns 321 and 322, the auxiliary lead-out patterns 331 and 332, and the via 340 may include at least one conductive layer.

For example, when the first coil pattern 311, the first lead-out pattern 321, the second auxiliary lead-out pattern 332, and the via 340 are formed on one surface of the substrate 200 by plating, each of the first coil pattern 311, the first lead-out pattern 321, the second auxiliary lead-out pattern 332, and the via 340 may include a seed layer and an electroplating layer. The seed layer may be formed by a vapor deposition method such as electroless plating or sputtering. Each of the seed layer and the electroplating layer may have a single layer structure or a multilayer structure. The electroplating layer having a multilayer structure may be formed in a conformal film structure in which one electroplating layer covers the other electroplating layer, and may be formed in a shape in which the other electroplating layer is stacked only on one surface of the one electroplating layer. The seed layer of the first coil pattern 311 and the seed layer of the via 340 may be integrally formed so as not to form a boundary therebetween, but is not limited thereto. The electroplating layer of the first coil pattern 311 and the electroplating layer of the via 340 may be integrally formed so as not to form a boundary therebetween, but is not limited thereto.

Each of the coil patterns 311 and 312, the lead-out patterns 321 and 322, and the auxiliary lead-out patterns 331 and 332 may be formed of a conductive material such as copper (Cu), aluminum (Al), silver (Ag), tin (Sn), gold (Au), nickel (Ni), lead (Pb),titanium (Ti), molybdenum (Mo) or alloys thereof, but a material thereof is not limited thereto. As a non-limiting example, the first coil pattern 311 may include a seed layer including molybdenum (Mo) and a plating layer disposed on the seed layer and including copper (Cu).

An insulating film 400 is disposed between each of the support substrate 200 and the coil portion 300 and the body 100. In the present embodiment, since the body 100 includes magnetic metal powder, the insulating film 400 is disposed between the coil portion 300 and the body 100 to insulate the coil portion 300. The insulating film 400 may be formed of parylene, but is not limited thereto.

The external electrodes 500 and 600 are disposed to be spaced apart from each other on one surface 106 of the body 100, and are connected to the first and second lead-out patterns 321 and 322, respectively. The first external electrode 500 covers the first lead-out pattern 321 to be in contact with the first lead-out pattern 321, and the second external electrode 600 covers the second lead-out pattern 322 to be in contact with the second lead-out pattern 322.

The external electrodes 500 and 600 electrically connect the coil component 1000 to the printed circuit board, or the like, when the coil component 1000 according to the present embodiment is mounted on the printed circuit board, or the like. As an example, the coil component 1000 according to the present embodiment may be mounted such that the sixth surface 106 of the body 100 faces the upper surface of the printed circuit board. Since the external electrodes 500 and 600 are disposed to be spaced apart from each other on the sixth surface 106 of the body 100, the connection portion of the printed circuit board may be electrically connected.

The external electrodes 500 and 600 include a first conductive layer 10 disposed on the body 100, and in direct contact with the body 100, the lead-out patterns 321 and 322, and the auxiliary lead-out patterns 331, and 332 a second conductive layer 20 disposed on the first conductive layer 10 and covering the first conductive layer 10, respectively. Each of the first conductive layer 10 and the second conductive layer 20 may be a conductive resin layer or a plating layer. The conductive resin layer may be formed by printing a conductive paste and curing the paste. The conductive paste may include any one or more conductive metals selected from a group consisting of copper (Cu), nickel (Ni), and silver (Ag) and a thermosetting resin. The plating layer may include any one or more selected from a group consisting of copper (Cu), nickel (Ni), and tin (Sn).

The interface between the end portion of the coil portion 300 and the external electrodes 500 and 600 and the interface between the surface of the body 100 and the external electrodes 500 and 600 may be located at different levels.

Referring to FIGS. 3 to 8, levels D and D' of the interface between the first lead-out pattern 321 and the first external electrode 500 exposed to the first surface 101 of the body 100 is different from a level E of the interface between the first surface 101 of the body 100 and the first external electrode 500. A level of the interface may mean an average level. This will be hereinafter described.

The thin film coil component includes a process that proceeds to a large area substrate, a process of dicing the large area substrate to a size corresponding to the body of individual components, and a process that proceeds to the body of the individual components. Meanwhile, at least a portion of the material constituting the substrate, the magnetic composite sheet, and the coil portion during the dicing process may be extended and disposed to the surface of the individual body by being pushed by physical properties such as ductility and elasticity of the material, pressure of the dicing blade in the dicing process, and the like. When the external electrode is formed on the surface of the body in such a state, there is a possibility that a coupling force between each of the body and the end portion of the coil portion and the external electrode is lowered, and there is a possibility of poor appearance based on the final product. Therefore, in the related art, a polishing process is performed to remove the above-mentioned foreign substances remaining on the surface of the body after the cutting process. However, as the size of the body gradually decreases, it may be difficult to perform the above-mentioned polishing process. In setting a level of the surface of the body that is a basis of the polishing process, even if an error of the same level, the error may be in a range that is unacceptable for a body of a relatively small size. In addition, in setting a degree of polishing (polishing thickness), even if an error of the same level, the error may be in a range that is unacceptable for a body of a relatively small size. Therefore, as the size of the body decreases, a process error in the above-described process must be more precisely controlled, but it may have limitations unless a polishing equipment is changed.

In the present disclosure, it is intended to overcome limitation of polishing that occurs as the size of the body becomes smaller. That is, in the present disclosure, a polishing process itself is eliminated. Specifically, the first lead-out pattern 321, an end portion of the coil portion 300, is subjected to an acid treatment on the exposed surface exposed to the surface of the body 100. Burr of the first lead-out pattern 321 extending onto the surface of the body 100 during the dicing process due to ductility may be removed.

An acid treatment may be performed using an etchant reacting to a material forming the first lead-out pattern 321. For example, when the first lead-out pattern 321 is made of copper (Cu), acid treatment may be performed using a copper etchant reacting to copper (Cu). Due to the acid treatment, a surface roughness of the exposed surface of the first lead-out pattern 321 may be higher than a surface roughness of the other surface of the first lead-out pattern 321. The other surface of the first lead-out pattern 321 may be a surface which is not exposed from the body and which is not subjected to the acid treatment. Such a surface may be embedded in the body 100. In addition, the surface roughness of the exposed surface of the first lead-out pattern 321 may be higher than the surface roughness of the surface of the body 100, such that a surface roughness of the interface between the first lead-out pattern 321 and the first external electrode 500 may be higher than a surface roughness of the interface between the surface of the body 100 and the first external electrode 500.

Referring to FIG. 4, an interface between the first lead-out pattern 321 and the first external electrode 500 may be located at a lower level than an interface between the surface of the body 100 and the external electrode 500 (D<E), with respect to a portion, for example, a plane, inside the coil component 1000. After the dicing process, the surface of the body 100 and the exposed surface of the first lead-out pattern 321 are located at substantially the same level. By removing a portion of the first lead-out pattern 321 by acid treatment, after the acid treatment, an average level D of the exposed surface of the first lead-out pattern 321 may be lower than an average level E of the surface of the body 100. Therefore, an interface between the first lead-out pattern 321 and the first external electrode 500 may be located on a level lower than an interface between the surface of the body 100 and the external electrode 500. A difference in an average level (difference in E and D) between the exposed surface of the first lead-out pattern 321 and the surface of the body 100 may be adjusted by acid treatment conditions such as an acid treatment time. An average level may be determined by, for example, a surface profile measurement tool such as an atomic force microscope, by a technique recognized by those skilled in the art. An average level may be an average of distances of measured points of a region of interested to a reference plane. FIG. 4 shows an example in which a portion, burr of the first lead-out portion 321 extending to the surface of the body 100, is all removed.

Referring to FIG. 5, the interface between the first lead-out pattern 321 and the first external electrode 500 may be located on a level higher than the interface between the surface of the body 100 and the external electrode 500 (D'>E). This corresponds to a case in which a portion, burr of the first lead-out portion 321 extending to the surface of the body 100, is left without being entirely removed, and an etching amount is relatively smaller than the case in FIG. 4. In the case of FIG. 5, it is possible to significantly reduce the contact are between dissimilar materials (contact area between the external electrode and the body). That is, FIG. 5 shows a case in which a portion burr of the first lead-out portion 321 extending onto the surface of the body 100 is intentionally partially left.

Meanwhile, the description has been focused on the first lead-out pattern 321, but the same description may be applied to the first auxiliary lead-out pattern 331. As a result, in the coil component according to the present embodiment, as illustrated in FIGS. 7 and 8, the exposed surface of the first auxiliary lead-out pattern 331 may have a difference in surface roughness and a level difference of the interface between the first external electrodes 500,as compared with the surface of the body 100. The description of FIG. 4 may be applied to FIG. 7, and the description of FIG. 5 may be applied to FIG. 8. In addition, the above description may be equally applied to the exposed surfaces of the second lead-out pattern 322 and the auxiliary lead-out patterns 331 and 333.

In addition, although the above description has been made on the premise that a portion, burr of the first lead-out portion 321, remains on the surface of the body 100, the portion, burr of the first lead-out portion 321, may extend to the surface of the body 100 and/or the exposed surface of the first end portion 221 in a processing direction of a dicing blade in the dicing process. The same may be also applied to the second lead-out portion 321 and the auxiliary lead-out portion 331 and 332.

As set forth above, according to the present disclosure, a polishing process may be omitted when manufacturing components.

In addition, according to the present disclosure, coupling reliability between the end portion of the coil portion and the external electrode may be improved.

While the exemplary embodiments have been shown and described above, it will be apparent to those skilled in the art that modifications and variations could be made without departing from the scope of the present invention as defined by the appended claims.

What is claimed is:

1. A coil component, comprising:

a body includes first and second surfaces opposing each other, and a third surface connected to the first and second surfaces;

a support substrate embedded in the body;

a coil portion disposed on the support substrate, and having an end portion towards the first surface of the body; and an external electrode including a portion disposed on the first surface of the body to protrude, in a direction away from the first surface of the body, from the body, and another portion connected to the portion of the external electrode to be in contact with the end portion of the coil portion, wherein with reference to the first surface, an interface between the end portion of the coil portion and the another portion of the external electrode and an interface between the first surface of the body and the portion of the external electrode are located on levels different from each other.

2. The coil component of claim 1, wherein the interface between the end portion of the coil portion and the another portion of the external electrode is located on a level, lower than the interface between the first surface of the body and the external electrode, with reference to a portion inside the coil component.

3. The coil component of claim 1, wherein the interface between the end portion of the coil portion and the another portion of the external electrode is located on a level, higher than the interface between the first surface of the body and the external electrode, with reference to a portion inside the coil component.

4. The coil component of claim 3, wherein at least a portion of the end portion of the coil portion extends onto the first surface of the body.

5. The coil component of claim 1, wherein a surface roughness of one surface of the end portion exposed from the first surface of the body is higher than a surface roughness of the surface of the end portion of the coil portion except for the one surface.

6. The coil component of claim 1, wherein the coil portion comprises:

a first coil pattern disposed on one surface of the support substrate;

a second coil pattern disposed on another surface of the support substrate facing the one surface of the support substrate;

a first lead-out pattern disposed on the one surface of the support substrate and connected to the first coil pattern, the first lead-out pattern extending along the first surface of the body;

a second lead-out pattern disposed on the another surface of the support substrate and connected to the second coil pattern, the second lead-out pattern extending along the second surface of the body; and a via penetrating through the support substrate to connect the first coil pattern and the second coil pattern to each other.

7. The coil component of claim 6, wherein the first lead-out pattern extends continuously from the first surface to the third surface of the body, and the second lead-out pattern extends continuously from the second surface to the third surface of the body.

8. The coil component of claim 7, wherein winding axes of each of the first and second coil patterns are substantially parallel to the third surface of the body.

9. The coil component of claim 6, further comprising:

a first auxiliary lead-out pattern disposed on the another surface of the support substrate and spaced apart from the second coil pattern, the first auxiliary lead-out pattern extending along the first surface of the body; and a second auxiliary lead-out pattern disposed on the one surface of the support substrate and spaced apart from the first coil pattern, the second auxiliary lead-out pattern extending along the second surface of the body.

10. The coil component of claim 1, wherein a surface roughness of the interface between the end portion of the coil portion and the external electrode is higher than a surface roughness of the interface between the first surface of the body and the external electrode.

11. The coil component of claim 1, wherein a surface roughness of one surface of the end portion exposed from the surface of the body is higher than a surface roughness of the first surface of the body.

12. The coil component of claim 1, wherein the external electrode comprises a first conductive layer disposed on the body, and in contact with the body and the end portion of the coil portion, and a second conductive layer disposed on the first conductive layer to cover the first conductive layer.

13. A coil component, comprising:

a body includes first and second surfaces opposing each other, and a third surface connected to the first and second surfaces;

a support substrate embedded in the body;

a coil portion disposed on the support substrate, and having a first lead-out pattern extending along the first surface and the third surface of the body; and an external electrode disposed on the first surface and the third surface of the body to protrude from the first surface and the third surface of the body, and being in contact with the lead-out pattern of the coil portion, wherein with respect to the first surface or the third surface of the body, an interface between the lead-out portion and the external electrode and an interface between the body and the external electrode are located on levels different from each other.

14. The coil component of claim 13, wherein a portion of the coil portion extends onto the first surface or the third surface of the body.

15. The coil component of claim 13, wherein the coil portion comprises:

a first coil pattern disposed on one surface of the support substrate;

a second coil pattern disposed on another surface of the support substrate facing the one surface of the support substrate;

the first lead-out pattern disposed on the one surface of the support substrate and connected to the first coil pattern;

a second lead-out pattern disposed on the another surface of the support substrate and connected to the second coil pattern, the second lead-out pattern extending along the second surface and the third surface of the body; and a via penetrating through the support substrate to connect the first coil pattern and the second coil pattern to each other.

16. The coil component of claim 15, wherein the first lead-out pattern extends continuously along the first surface to the third surface of the body, and the second lead-out pattern extends continuously along the second surface to the third surface of the body.

17. A coil component, comprising:

a body includes first and second surfaces opposing each other, and a third surface connected to the first and second surfaces;

a support substrate embedded in the body;

a coil portion disposed on the support substrate, and having an end portion towards the first surface of the body; and an external electrode including a portion disposed on the first surface of the body to protrude from the first surface of the body, and another portion connected to the portion of the external electrode to be in contact with the end portion of the coil portion, wherein a surface roughness of the interface between the end portion of the coil portion and the another portion of the external electrode is higher than a surface roughness of the interface between the first surface of the body and the one portion of the external electrode.

18. The coil component of claim 17, wherein a surface roughness of one surface of the end portion exposed from the surface of the body is higher than a surface roughness of the first surface of the body.

19. The coil component of claim 17, wherein a portion of the coil portion extends onto the first surface or the third surface of the body.

20. The coil component of claim 17, wherein the coil portion comprises:

a first coil pattern disposed on one surface of the support substrate;

a second coil pattern disposed on another surface of the support substrate facing the one surface of the support substrate;

a first lead-out pattern disposed on the one surface of the support substrate and connected to the first coil pattern, the first lead-out pattern extending along the first surface of the body;

a second lead-out pattern disposed on the another surface of the support substrate and connected to the second coil pattern, the second lead-out pattern extending from the second surface of the body; and a via penetrating through the support substrate to connect the first coil pattern and the second coil pattern to each other.

* * * * *